United States Patent [19]

Burton

[11] 4,264,000

[45] Apr. 28, 1981

[54] PROTECTIVE CIRCUIT FOR COIN OPERATED VENDING MACHINES

[75] Inventor: Paul F. Burton, Charles Town, W. Va.

[73] Assignee: Dixie-Narco, Inc., Charles Town, W. Va.

[21] Appl. No.: 26,574

[22] Filed: Apr. 3, 1979

[51] Int. Cl.[3] ..... G07F 1/02

[52] U.S. Cl. ..... 194/97 R; 194/1 E

[58] Field of Search ..... 194/97 R, 1 K, 1 E; 340/603, 604; 307/100, 118; 361/54

[56] References Cited

U.S. PATENT DOCUMENTS

| | | | |
|---|---|---|---|
| 2,893,531 | 7/1959 | Hebel | 194/97 R |
| 3,482,110 | 12/1969 | Robinson | 194/97 R X |
| 4,062,435 | 12/1977 | Chalabian | 194/1 K X |
| 4,080,598 | 3/1978 | Cardone | 194/97 R X |

*Primary Examiner*—Robert J. Spar
*Assistant Examiner*—Edward M. Wacyra

[57] ABSTRACT

A coin operated vending machine has a pair of spaced conductors mounted on a coin chute and in position to be bridged by any electrically conductive liquid squirted into the coin slot. Bridging of the conductors by the liquid completes a circuit which disconnects vending circuitry from its power source. The spaced conductors are mounted on a non-conductive support which prevents a coin itself from contacting and bridging the conductors.

5 Claims, 3 Drawing Figures

PROTECTIVE CIRCUIT FOR COIN OPERATED VENDING MACHINES

BACKGROUND OF THE INVENTION

This invention relates to an electrical circuit means to be attached to a conventional vending machine, operated by coins, to prevent certain types of vandalism.

Many coin operated vending machines are in use for dispensing or vending a multitude of types of product. Such machines are subject to vandalism or thievery by unscrupulous persons. Almost universally such vending machines include a coin slot through which a coin is inserted and electrically operated means actuated by the coin for effecting dispensing of a predetermined amount of product, and/or returning change to the buyer if necessary. Vandals and thieves have developed a technique for obtaining product or money from such machines without the use of coins. Through the use of plastic squeeze bottles or the like, people are flooding conductive solutions, such as salt solution or battery acid into the coin slot of vending machines. This solution runs down into the coin chute and changer and plays havoc with coin changer circuit boards, switches and so forth. Depending on the flow of the liquid and the design of the electrical circuits in the changer and vendor, it may "jackpot" the coin tubes and dump all the money in the coin return or set up the vendor so all of the products can be dispensed without further action on the vandals part. While this is happening, the expensive electronic circuitry in the changer and vendor mechanism, with the power still on, can be ruined.

SUMMARY OF THE INVENTION

The principle of the present invention is to kill power to the complete vending circuit and coin changer immediately when liquid is flooded into the coin slot. This eliminates the pay out of money or product and prevents the electrical damage that would occur to the changer. The main purpose, of course, is to discourage the thief by not rewarding him for his efforts.

In general, the invention comprises a pair of conductors positioned near the coin path defined by the coin guiding chute, and arranged so that a coin entering the chute will not bridge the conductors, and thus will not complete the protective electrical circuit. However, if a conducting liquid is squirted through the coin slot, it will bridge across the conductors, thus completing a circuit to kill power to the electrical portions of the vending machine. The patents to Chen, U.S. Pat. No. 4,070,670, Hatfield, U.S. Pat. No. 4,020,478, and Davidson el al., U.S. Pat. No. 3,525,902, illustrate moisture sensing devices in combination with coin operated devices, but the purpose therein was to sense ambient moisture to prevent short-circuiting of the systems. Other devices such as shown in U.S. Pat. No. 3,944,845 utilize spaced electrodes for the purpose of detecting the level of an electrically conducting fluid, but such devices are not suggestive of the present invention.

Other patents such as U.S. Pat. Nos. 3,929,213 and 3,059,749 disclose structure having some similarity to the present invention, and in which parallel plates are placed in the coin paths, but they actually contact the coins for testing of the coins for counterfeits or the like.

DESCRIPTION OF THE PREFERRED EMBODIMENT

Figure 1:
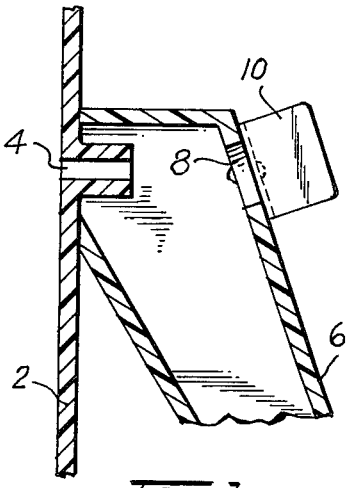
FIG. 1 is a fragmentary sectional view through a portion of a machine having a coin slot and coin guiding chute therein.
Figure 2:
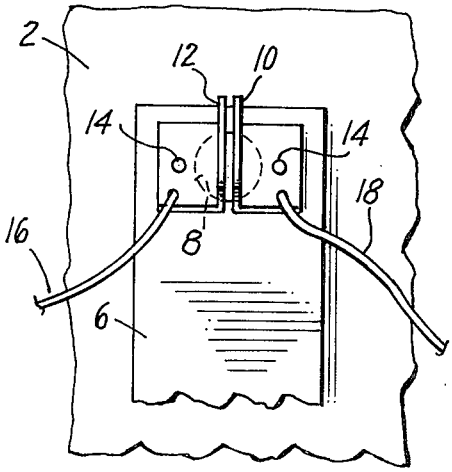
FIG. 2 is an elevational view of the portion shown in FIG. 1 as viewed from the right-hind side of that figure.

Referring first to FIG. 1, numeral 2 designates the front wall of a coin vending machine, and in which a coin receiving slot 4 is provided. Numeral 6 designates a guiding chute for the coins to direct the same to an electrical device for operating the vending machine to dispense a product or to return change to the purchaser. Preferably the chute 6 is made of a non-conducting plastic material.

The rear wall of the chute 6, in substantial alignment with the coin slot 4, is provided with an opening 8 therethrough. Mounted on the rear surface of the coin chute 6 is a pair of conductive plates 10 and 12. The plates are secured to the coin chute by means of rivets 14 or the like and are arranged so that they are in generally spaced parallel relationship directly behind the opening 8. The spacing between the plates 10 and 12 is sufficient to provide discontinuity in the electrical circuit, including conductors 16 and 18, but close enough to retain therein any liquid that may be squirted through the coin slot 4, that liquid will bridge and stay in the space between the plates 10 and 12 and thus complete and hold an electrical circuit including the conductors 16 and 18.

Figure 3:
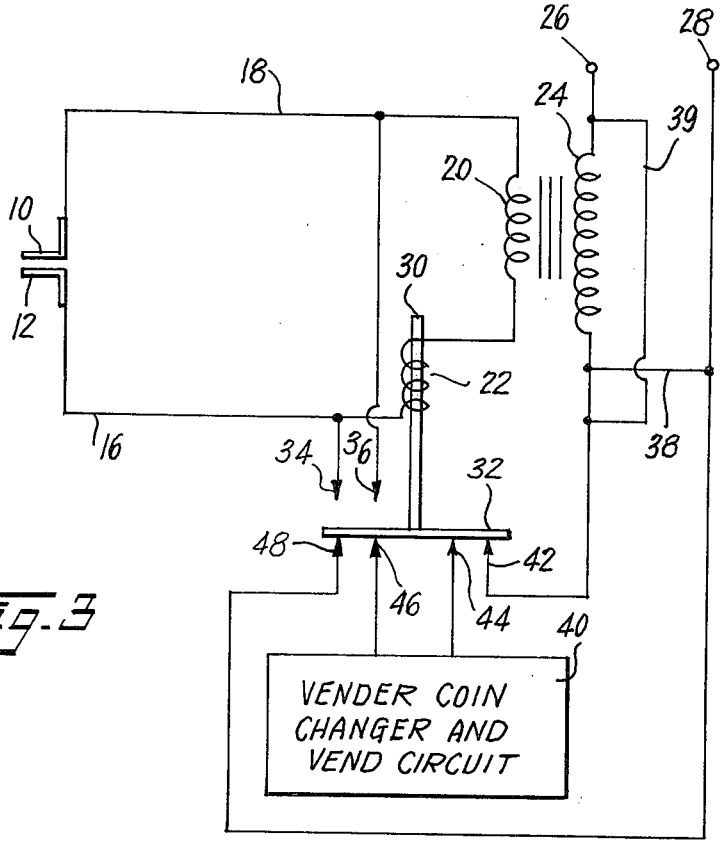
FIG. 3 is a schematic diagram of the electrical circuits employed in the present invention.

As shown in FIG. 3, the conductors 16 and 18 along with the plates 10 and 12 constitute a portion of a circuit including the secondary winding 20 of a transformer and the coil 22 of a relay. The plates 10 and 12 are connected in series with the transformer secondary winding 20 and the relay coil 22. The transformer secondary 20 is energized by a primary transformer winding 24 arranged in a power circuit designated by the terminals 26 and 28. The terminals 26 and 28 represent a source of electrical power, usually 115 to 120 volts. The transformer 20–24 steps the voltage down for use by the relay coil 22.

The relay includes further an armature 30 and a contactor 32. In its normal position, the armature is in the lower position as shown in FIG. 3.

Connected in parallel with the spaced plates 10 and 12 are a pair of contacts 34 and 36 which, with the contactor 32 defines a first normally open switch. The contact 34 is connected to the conductor leading to plate 12, whereas the contact 36 is connected to the conductor 18 leading to plate 10. Thus, the switch 32, 34, 36 is in parallel with the plates 10 and 12. A shunt conductor 38 is placed across the power line to provide current to the transformer 20–24, even at times when no current is being drawn by the vending circuitry of the machine and conductor 39, in parallel with coil 24 directs line voltage to device 40.

Numeral 40 designates generally a coinactuated device operated by the electrical power and which responds to the receipt of a coin therein to effect vending of a product and/or returning change to the buyer. The details of this coin-actuated mechanism or device are not shown since it may take many and varied forms, many of which are in use today and conventional in coin vending apparatus. It being sufficient to point out that receipt of a coin by the device 40 will actuate suitable electrical circuits to effect vending of one or more items of the product, and/or return necessary change to the buyer.

In the normal and illustrated position of the relay contactor 32, power is supplied to the device 40 through contacts 42 and 44 and contactor 32. In addition, power may be supplied to a different portion of the device 40 through contacts 46 and 48 and contactor 32 of the relay. Each pair of contacts and the contactor 32 constitute normally closed switches.

In normal operation, the parts remain in the relative positions shown in FIG. 3 and the machine is operated in the usual and conventional manner. However, if a vandal should introduce a conductive liquid through the coin slot 4, it will form a conductive bridge across plates 10 and 12, and thus complete a circuit through the transformer secondary 20 and relay 22. Energizing the relay coil 22 will lift the armature, thus opening the switches constituted by contacts 42–44 and 46–48 and at the same time will close the switch defined by contact 34–36. As will be apparent, this action immediately cuts all power to the device 40, thus preventing the machine from either delivering any of the product or returning change or other coins to the vandal. At the same time, switch 34–36 is closed thus completing a circuit through the transformer secondary and relay coil 22 holds the coil energized even if the liquid between plates 10 and 12 were to be removed. Thus, a holding circuit is provided to hold the relay in its activated condition.

It is possible at this time for the vandal to remove the main plug of the machine, thus denying power to the relay, causing the relay to drop out and re-establish the circuit through the device 40. To minimize the chances of such a type of operation, the plates 10 and 12 are placed sufficiently close, so that any liquid squirted therein to bridge the conductors and complete the previously described circuit will remain between those plates for a substantial length of time. Thus, even if the vandal were to pull the main plug to let the relay drop out and would then reinsert the plug, the liquid still between plates 10 and 12 would again energize the relay to deny power to the circuit.

While the opening 8 and plates 10 and 12 are shown and described as being directly behind the coin slot 4, it will be obvious that they could be placed anywhere along the coin chute 6 where the liquid would normally flow.

It will be apparent that the present device provides a safety feature preventing damage to the device 40 and the circuits therein, even though the liquid may damage that circuit by itself. Nevertheless, the vandal will be denied any product or money and thus will be discouraged from attempting this technique.

While a single specific form of the invention has been shown and described herein, the same is not to be considered to limit the invention. The invention is deemed to encompass all forms of the device falling within the scope of the appended claims.

I claim:

1. In a coin operated vending machine having a coin receiving slot, coin guiding means defining a coin path and electrical coin-actuated means, operable from a source of electric power for dispensing a product, the improvement comprising:

spaced and fixed electrical conductors adjacent said coin slot and exposed to both said coin slot and said coin path;

means for preventing bridging of said conductors by a coin in said coin path; and circuit means connected to said source of electric power and responsive to bridging of said conductors by a conductive material injected into said coin path through said coin slot to disconnect said electrical coinactuated means from its electric power source.

2. The device of claim 1 wherein said spaced conductors comprise a pair of spaced parallel conductive plates spaced apart sufficiently to normally break the continuity of said circuit means, but near enough to each other to retain a conductive liquid therebetween to maintain continuity of said circuit means.

3. The device of claim 1 wherein said circuit means includes holding means for holding said coin-actuated means disconnected from its source of power.

4. The device of claim 3 wherein said means responsive to bridging of said conductors includes a relay in said circuit means arranged to be energized by bridging of said conductors;

at least one normally closed switch connecting said coin-actuated means to said source of power; and a normally open switch in said circuit means in parallel with said conductors, which, when closed, maintains said relay energized;

said relay, when energized, functioning to open said normally closed switch and to close said normally open switch.

5. A device as defined in claim 1 wherein said coin guiding means comprises a chute of nonconductive material and having a wall portion spaced inwardly from said coin slot, an opening through said wall portion generally in alignment with said coin slot, and said spaced conductors being mounted on the side of said wall portion opposite said coin slot and over said opening, said wall portion adjacent said opening constituting said means for preventing bridging of said conductors by a coin.

* * * * *